US005957277A

United States Patent [19]

Elliott

[11] Patent Number: 5,957,277

[45] Date of Patent: Sep. 28, 1999

[54] PORTABLE POCKET HUMIDIFIER

[75] Inventor: J. Patrick Elliott, Brighton, Mich.

[73] Assignee: Heritage Humidors Inc., Brighton, Mich.

[21] Appl. No.: 09/063,721

[22] Filed: Apr. 21, 1998

[51] Int. Cl.[6] ..... B65D 81/24

[52] U.S. Cl. ..... 206/205; 206/269; 312/31

[58] Field of Search ..... 206/205, 242, 206/269, 524.4; 312/31; 1311/302, 303

[56] References Cited

U.S. PATENT DOCUMENTS

| | | | |
|---|---|---|---|
| D. 386,812 | 11/1997 | Schmidt . | |
| D. 389,601 | 1/1998 | Bartolotta . | |
| D. 391,669 | 3/1998 | DuBow . | |
| 3,135,566 | 6/1964 | Frank | 312/31 |
| 3,142,380 | 7/1964 | Patrick et al. | 312/31 |
| 3,431,038 | 3/1969 | Berliner | 312/31 |
| 4,711,254 | 12/1987 | Fleisher et al. . | |
| 4,901,850 | 2/1990 | McIntosh | 206/205 |
| 4,907,604 | 3/1990 | Beloff . | |
| 5,011,009 | 4/1991 | Scheurer . | |
| 5,687,749 | 11/1997 | Brauer, Jr. | 312/31 |

OTHER PUBLICATIONS

Packaging for Advantage 70 Cigar Tube.

*Primary Examiner*—Paul T. Sewell
*Assistant Examiner*—Luan K. Bui
*Attorney, Agent, or Firm*—Gifford, Krass, Groh, Sprinkle, Anderson & Citkowski, P.C.

[57] ABSTRACT

A device for enclosing and maintaining a constant humidity of a cigar, the device including an elongate and polygonal shaped body in cross section and having a first closed end and a second open end suitable for receiving the cigar in an axially inserting fashion. A cap portion is resiliently engageable with the second open end to hermetically seal the interior cavity of the device. The cap portion includes an established axial length which defines an open interior and within which is secured a plurality of poly-acrylite crystals, each capable of absorbing a desired quantity of a moisturizing fluid. A mesh screen portion is provided for retaining the plurality of crystals within the interior cavity of the cap portion and, during use, establishes the desired moisture level within the device.

7 Claims, 1 Drawing Sheet

PORTABLE POCKET HUMIDIFIER

BACKGROUND OF THE INVENTION

1. Field of the Invention

The present invention relates generally to cigar storage and humidification devices and, more particularly, to an elongate and tubular shaped cigar humidification device which is easily carried in the pocket of a user and which is an improvement over such prior art and portable humidification devices.

2. Description of the Prior Art

Cigar storage and humidification devices are well documented in the prior art, the purpose for which is to maintain the freshness and humidity level of cigars prior to them being consumed. As is well known, the absence of a suitable humidifying environment will result in a cigar quickly drying out and losing its appeal. The more traditional type of humidification devices, or humidors, are fairly large in size and are designed for holding a larger number of cigars in a humidified environment. These larger humidors are typically constructed in the form of a rectangular box with a hingedly connected lid. Other larger such humidors are constructed as cylindrical shaped sleeve members with frictionally engageable lids.

While very effective, the drawback of such larger devices is that they are not capable of being easily transported about. Accordingly, it has become desirable for one to be able to carry about at least a single cigar in a humidified environment. An example of such a device illustrated by the Advantage 70 Humidified Cigar Tube. The Advantage 70 incorporates a cylindrically shaped tube portion upon which is engageably seated a cap. The cap includes an internal sponge portion capable of absorbing a determined volume of liquid, such as water, an O-ring for biasingly and hermetically sealing the cap portion to the end of the tube and a baffled vent for permitting a measured degree of moisture to escape the cap portion and permeate the interior of the tube within which a cigar is held. While providing a very effective and useful portable humidification device, the drawback of the Advantage 70 model is that the sponge portion is capable of only absorbing a relatively small amount of fluid at a time and, accordingly, it is necessary to re-moisturize fairly often in order for the device to retain its usefulness. Also, the complexity of the Advantage 70 design is such that it is fairly expensive to produce and sell.

U.S. Pat. No. 5,011,009, issued to Scheurer, discloses a cigar storage and transportation container for a cigar. The container includes inner and outer tubular components which are telescoped one within the other and in order to enclose an inserted cigar. Each tubular member further includes an elongate slot formed therethrough such that, upon appropriate rotation of the inner and outer tubular components relative to one another, communication is provided between the interior and exterior of the container and so that a cigar held therein may be readily exposed to the regulated environment of a humidor. As explained by its disclosure, the device of Scheurer does not teach or disclose any form of built-in moisturizing means. Rather, the purpose of Scheurer is to provide a device wherein a transported cigar which may have dried out is capable of being restored to an optimum condition inside a conventional humidified room enclosure, following which the interior of the container is sealed.

Additional examples of designs of conventional cigar humidors are illustrated in U.S. Design Pat. No. 391,669, issued to DuBow, U.S. Design Pat. No. 386,812, issued to Schmidt, and U.S. Design Pat. No. 389,601, issued to Bartolotta.

SUMMARY OF THE PRESENT INVENTION

The present invention is an improved device for enclosing and maintaining a constant humidity of a cigar which is held within the device. The device includes an elongate and substantially tubular shaped body having a first closed end and a second open end and which defines an interior cavity of suitable dimension receiving the cigar in an axially inserting fashion. A cap portion is resiliently engageable with the open second end of the tubular shaped body and includes an established axial length for sealing within the tube and which also defines an open interior of the cap. A radially projecting tab portion permits the cap portion to be resiliently disengaged from the end of the tube.

Humidification means are provided for establishing a desired moisture level within the interior cavity and includes a plurality of poly-acrylite crystals. The crystals are capable of absorbing and holding a large multiple of their weight in fluid, such as water, and are preferably secured to the interior of the cap portion by a mesh screen. The screen is a particularly desirable means for securing the crystals in place while at the same time permitting moisture to emanate from the crystals throughout the interior cavity of the tube. The crystals are further such that they are capable of retaining much larger volumes of water or other suitable fluid than that which is provided for by sponges or other prior art water retaining devices and, consequently, need only to be re-moisturized at significantly longer intervals.

BRIEF DESCRIPTION OF THE DRAWINGS

Reference will now be had to the attached drawings, when read in combination with the following specification, wherein like reference numerals refer to like parts throughout the several views, and in which.

DETAILED DESCRIPTION OF THE PREFERRED EMBODIMENT

Figure 1:
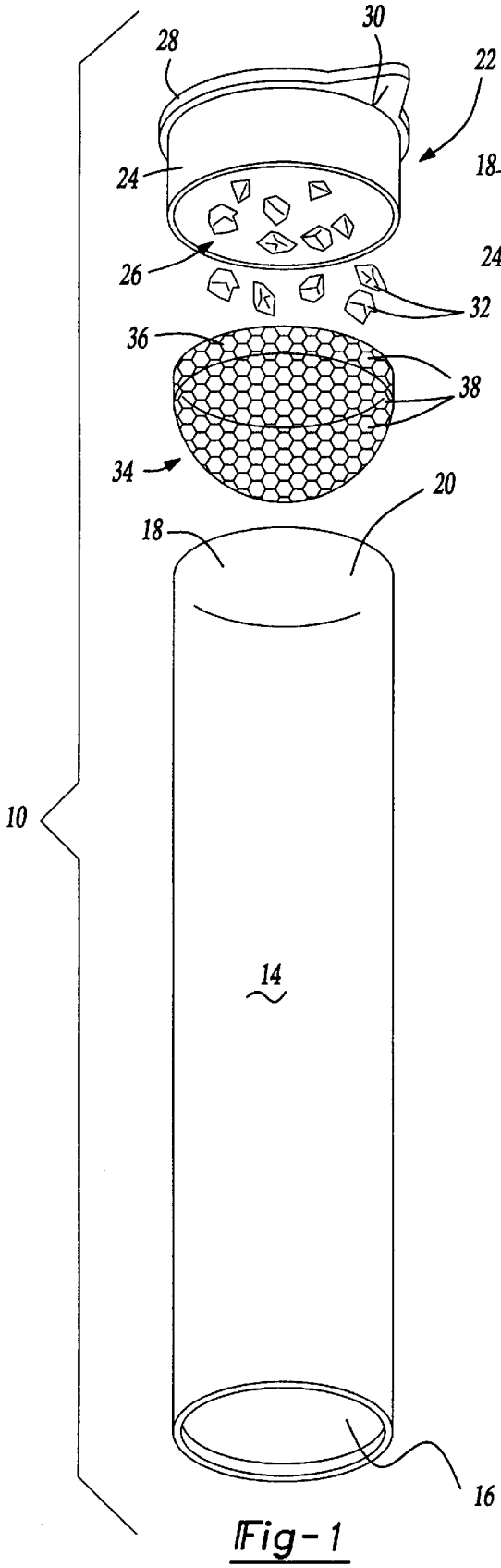
FIG. 1 is an exploded view in perspective of the device for maintaining a constant humidity of a cigar according to a preferred embodiment of the present invention.
Figure 2:
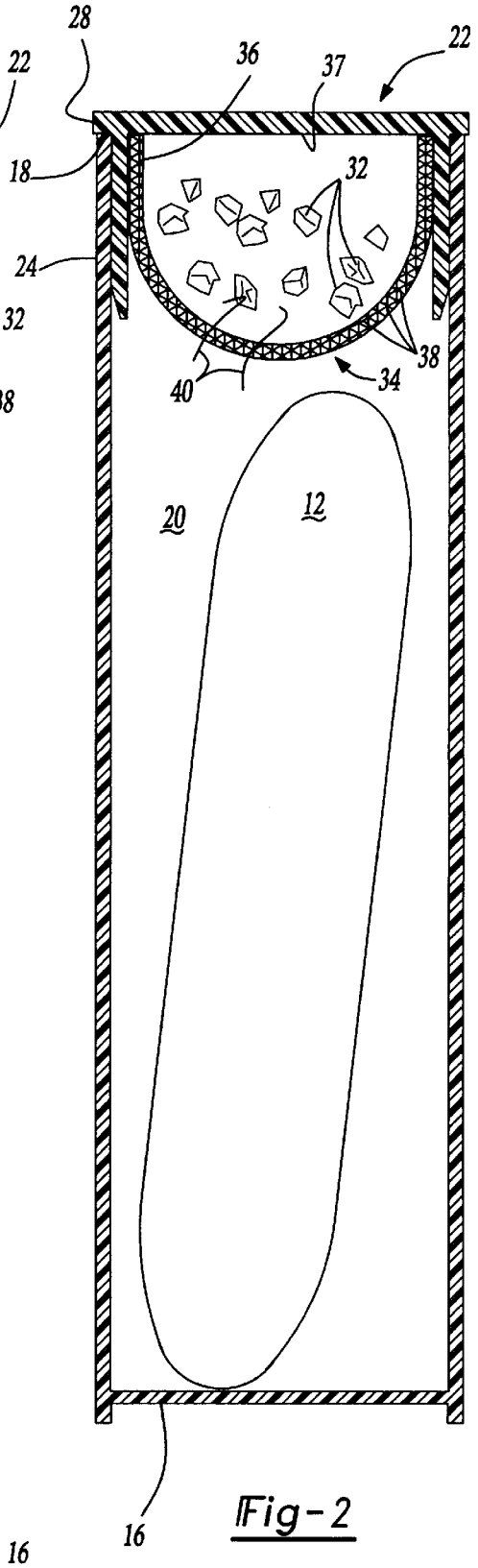
FIG. 2 is a cutaway in frontal section of FIG. 1 and illustrating the hermetically sealing nature and internal moisturizing/humidifying capability of the device of the present invention.

Referring now to FIG. 1, a device is illustrated at 10 for enclosing and maintaining a constant humidity of a cigar 12 (see FIG. 2), the cigar 12 being substantially elongate and tubular shaped as is well known in the art. The device 10 includes an elongate and substantially cross sectional polygonal shaped body 14 having a first closed end 16 (bottom end) and a second open end 18 (top end) and defining an open interior cavity 20 of suitable dimension for receiving the cigar 12 in an axially inserting fashion. The polygonal shaped body 14 can possess any number of sides in cross section ranging from triangular to circular, that being a polygon with an infinite number of sides. The cross section of the body 14 is preferably circular owing to conventional shape of the cigar being held within and the overall configuration of the device 10 is that of an elongate and substantially tubular shaped body. The body 14 is also preferably constructed of a plastic or polymer composite material and is transparent, however it is also contemplated that other types of materials can be employed without departing from the scope of the invention.

A cap portion 22 is provided and includes an annular side wall 24 of sufficient dimension and axial length such that it defines an open interior 26. The cap portion 22, similar to the polygonal and elongate shaped body 14, is preferably constructed of a resilient polymer material and is further deformable so as to permit the cap portion 22 to be resiliently engaged in a hermetically sealing fashion over the second open end 18 of the body 14 by biasingly engaging the outer face of the annular side wall 24 against the corresponding inner facing annular surface of the body 14 proximate the second open end 18. An annular projection 28 extends from the upper most end of the cap portion 22 and supports a radially projecting tab portion 30, the tab portion 30 facilitating gripping and resilient disengaging of the cap portion 22 from the second open end 18 of the elongate body 14 when it is desirable to remove the cigar 12 from the humidified interior cavity 20.

Humidifying means are provided for establishing a desired moisture level within the interior cavity 20 and include a plurality of fluid retaining polymer or poly-acrylite crystals 32. The poly-acrylite crystals 32 are by themselves known in the art as being capable of absorbing and retaining large volumes of water or other suitable fluid. It is documented that the crystals are capable, in instances, of retaining up to forty times their weight in fluid.

A mesh screen portion 34 is provided for securing the plurality of crystals 32 to the open interior 26 of the cap portion (and consequently the upper end of the interior cavity 20 of the elongate body 14). The screen portion 34 is preferably annular shaped in cross section to match the preferred embodiment of the cap portion 34 and tubular cross sectional shape of the body 14 and the screen portion 34 further includes an annular base 36 which is capable of being secured to a corresponding internal base surface 37 of the cap portion 22 such as by adhesives or other conventional means known in the art. The screen portion 34 provides a plurality of mesh openings 38 such that, upon retaining the crystals 32 in the operative engagement of FIG. 2, fluid vapor streams (illustrated by arrows 40) are permitted to pass therethrough and to humidity the cigar 12 held within the interior cavity 20. It is also contemplated that other types of porous retaining elements can be employed in substitution of the mesh screen portion 34 for holding the crystals 32 in place and without departing from the scope of the invention.

The preferred embodiment of the present invention is submitted to be a novel and non-obvious improvement over the prior art both in its simplified construction as well as the ability to maintain a desired humidity level within the interior cavity of the elongate tubular body by virtue of the moisture retaining capabilities of the poly-acrylite crystals. In this fashion, a cigar may be kept in storage within the portable device over fairly longer periods of time than that which is presently possible with other portable cigar retaining devices.

Having described my invention, additional embodiments will become apparent to those skilled in the art to which it pertains without deviating from the scope of the appended claims.

I claim:

1. A device for enclosing and maintaining a constant humidity of a cigar, said device comprising:

an elongate and polygonal shaped body in cross section, said body having a first closed end and a second open end which defines an interior cavity, the cigar capable of being axially inserted within said interior cavity;

a cap portion resiliently engageable with said second open end so as to hermetically seal said interior cavity of said elongate body, said cap portion having an established axial length which defines an open interior; and humidification means for establishing a desired moisture level within said interior cavity, said humidification means including a plurality of water retaining polymer crystals, a mesh screen portion retaining said polymer crystals within said open interior of said cap portion, said mesh screen including an annular shaped rim and being substantially semispherical shaped in dimension for accommodating said crystals;

wherein said plurality of polymer crystals absorb a desired volume of water or other suitable fluid prior to resiliently engaging said second end of said elongate body, said interior cavity within which the cigar is stored acquiring said desired moisture level.

2. The device according to claim 1, said polymer crystals further comprising poly-acrylite crystals.

3. The device according to claim 1, said elongate and polygonal shaped body further comprising a substantially tubular shape in cross section.

4. The device according to claim 3, said elongate and tubular shaped body being transparent.

5. The device according to claim 4, said elongate body and said cap portion being constructed of a polymer.

6. The device according to claim 1, said cap portion further comprising a radially projecting tab portion for facilitating gripping and resilient disengaging of said cap portion from said elongate and polygonally shaped body.

7. A device for enclosing and maintaining a constant humidity of a cigar, said device comprising:

an elongate and substantially tubular shaped body having a first closed end and a second open end which defines an interior cavity capable of receiving the cigar in axially inserting fashion;

a cap portion having an established axial length which defines an open interior and a radially projecting tab portion, said cap portion resiliently engaging with said second open end so as to hermetically seal said interior cavity of said elongate body; and humidification means for establishing a desired moisture level within said interior cavity, said humidification means including a plurality of water retaining poly-acrylite crystals, a mesh screen portion retaining said plurality of crystals within said interior of said cap portion;

wherein said poly-acrylite crystals absorb a desired volume of water or other suitable fluid prior to resiliently engaging said second end of said elongate body within which the cigar is held, said humidification means establishing the desired moisture level in hermetically sealed fashion during storage of the cigar, said tab being actuated to resiliently disengage said cap portion to remove the cigar from said device for consumption.

* * * * *